US011300071B2

(12) United States Patent
Fuqua

(10) Patent No.: US 11,300,071 B2
(45) Date of Patent: Apr. 12, 2022

(54) CYLINDER FOR OPPOSED-PISTON ENGINES

(71) Applicant: ACHATES POWER, INC., San Diego, CA (US)

(72) Inventor: Kevin B. Fuqua, San Diego, CA (US)

(73) Assignee: Achates Power, Inc., San Diego, CA (US)

( * ) Notice: Subject to any disclaimer, the term of this patent is extended or adjusted under 35 U.S.C. 154(b) by 419 days.

(21) Appl. No.: 14/732,496

(22) Filed: Jun. 5, 2015

(65) Prior Publication Data

US 2016/0356241 A1 Dec. 8, 2016

(51) Int. Cl.

| | |
|---|---|
| ***F02F 1/14*** | (2006.01) |
| ***F02F 1/00*** | (2006.01) |
| ***F02F 1/18*** | (2006.01) |
| ***F02B 25/08*** | (2006.01) |
| ***F02F 1/10*** | (2006.01) |
| ***F02B 75/28*** | (2006.01) |
| ***F01B 7/14*** | (2006.01) |
| *F01P 3/02* | (2006.01) |

(52) U.S. Cl.

CPC ..... *F02F 1/14* (2013.01); *F01B 7/14* (2013.01); *F02B 25/08* (2013.01); *F02B 75/28* (2013.01); *F02F 1/004* (2013.01); *F02F 1/10* (2013.01); *F02F 1/102* (2013.01); *F02F 1/186* (2013.01); *F01P 2003/021* (2013.01)

(58) Field of Classification Search

CPC ..... F02F 1/14; F02F 1/186; F01B 7/14; F02B 25/08; F02B 75/28

USPC ..... 123/41.72

See application file for complete search history.

(56) References Cited

U.S. PATENT DOCUMENTS

| | | | |
|---|---|---|---|
| 1,231,903 | A | 7/1917 | Junkers |
| 1,410,319 | A | 3/1922 | Junkers |
| 1,495,326 | A | 5/1924 | Junkers |

(Continued)

FOREIGN PATENT DOCUMENTS

| | | | |
|---|---|---|---|
| EP | 3300512 | B1 | 7/2021 |
| GB | 2503510 | A | 1/2014 |
| JP | 2014-521866 | | 8/2014 |
| WO | WO-2013/019433 | | 2/2013 |
| WO | WO 2013/019433 | A1 | 2/2013 |

OTHER PUBLICATIONS

International Search Report dated Aug. 12, 2016, for PCT application No. PCT/US2016/033819.

(Continued)

*Primary Examiner* — Lindsay M Low
*Assistant Examiner* — Omar Morales
(74) *Attorney, Agent, or Firm* — Terrance A. Meador

(57) ABSTRACT

A cylinder for opposed-piston engines includes a liner with a bore and longitudinally displaced intake and exhaust ports near respective ends thereof. An intermediate portion of the liner between the exhaust and intake ports contains a combustion chamber formed when the end surfaces of a pair of pistons disposed in opposition in the bore are in close mutual proximity. A compression sleeve encircles and reinforces the intermediate portion of the liner. An annular grid of pegs disposed between the intermediate portion and the compression sleeve supports the compression sleeve against the liner and defines a turbulent liquid flow path extending across the intermediate portion in a direction that parallels the longitudinal axis of the liner.

15 Claims, 6 Drawing Sheets

(56) References Cited

U.S. PATENT DOCUMENTS

| | | | | |
|---|---|---|---|---|
| 1,818,558 | A | 8/1931 | Junkers | |
| 1,892,277 | A | 12/1932 | Junkers | |
| 5,058,536 | A * | 10/1991 | Johnston | F02B 41/04 123/51 BA |
| 5,469,817 | A * | 11/1995 | Hoag | F02F 1/14 123/41.79 |
| 6,123,052 | A * | 9/2000 | Jahn | B22D 19/0081 123/193.2 |
| 6,182,619 | B1 * | 2/2001 | Spitzer | F02B 25/08 123/51 B |
| 8,333,026 | B2 | 12/2012 | Southard | |
| 8,485,147 | B2 | 7/2013 | Liu et al. | |
| 9,121,365 | B1 | 9/2015 | Wagner | |
| 2013/0025548 | A1 * | 1/2013 | Liu | F02B 75/282 123/41.17 |
| 2013/0298853 | A1 | 11/2013 | Liu et al. | |

OTHER PUBLICATIONS

'Maze—definition of maze by the Free Dictionary'. The Free Dictionary [online]. Farlex, Inc., © 2003-2017 [retrieved Apr. 19, 2017]. Retrieved from the Internet: <URL: http://www.thefreedictionary.com/maze>.

'Peg—definition of peg by the Free Dictionary'. The Free Dictionary [online]. Farlex, Inc., © 2003-2017 [retrieved Apr. 19, 2017], Retrieved from the Internet: <URL: http://www.thefreedictionary.com/peg>.

'Rib—definition of rib by the Free Dictionary'. The Free Dictionary [online]. Farlex, Inc., © 2003-2017 [retrieved Apr. 19, 2017], Retrieved from the Internet: <URL: http://www.thefreedictionary.com/rib>.

Communication pursuant to Article 94(3) EPC, dated Jun. 28, 2019, for European patent application No. 16727591.6.

Notification of First Office Action, dated Jun. 27, 2019, for Chinese patent application No. 2016800305187.

Notification of Second Office Action dated Mar. 2, 2020, for Chinese Patent Application No. 2016800305187.

Notification of Reasons for Refusal, dated Nov. 26, 2019, for Japanese patent application No. 2017-562311.

EPO Communication under Rule 71(3), Intention to Grant, with Druckexemplar, for EP application No. 16727591.6, dated Mar. 31, 2021.

EPO Form 2047, Transmission of Certificate of Grant of European patent No. 330051, dated Aug. 10, 2021.

* cited by examiner

CYLINDER FOR OPPOSED-PISTON ENGINES

RELATED APPLICATIONS

This Application contains subject matter related to the subject matter of commonly-owned U.S. application Ser. No. 13/136,402, filed Jul. 29, 2011 for "Impingement Cooling of Cylinders of Opposed-Piston Engines", published as US 2013/0025548 A1 on Jul. 31, 2013, now U.S. Pat. No. 8,485,147, issued on Jul. 16, 2013; commonly-owned U.S. application Ser. No. 13/942,515, filed Jul. 15, 2013 for "Impingement Cooling of Cylinders of Opposed-Piston Engines", published as US 2013/0298853 A1 on Nov. 14, 2013; and commonly-owned U.S. application Ser. No. 14/255,756, filed Apr. 17, 2014 for "Liner Component for a Cylinder of an Opposed-Piston Engines".

FIELD OF THE DISCLOSURE

The field relates to the structure of a cylinder for opposed-piston engines. More specifically the field is directed to strengthening and cooling cylinder liners for such engines.

BACKGROUND OF THE DISCLOSURE

The cylinder of an opposed-piston engine is constituted of a liner (sometimes called a "sleeve") retained in a cylinder tunnel formed in a cylinder block. The liner includes a bore and longitudinally displaced intake and exhaust ports, machined or formed in the liner near respective ends thereof. Each of the intake and exhaust ports includes one or more circumferential arrays of openings in which adjacent openings are separated by a solid portion of the cylinder wall (also called a "bridge"). In some descriptions, each opening is referred to as a "port"; however, the construction of a circumferential array of such "ports" is no different than the port constructions discussed herein.

Two pistons are disposed in opposition in a cylinder bore of an opposed-piston engine. The pistons reciprocate in mutually opposing directions in the bore, between respective top center (TC) and bottom center (BC) locations. An intermediate portion of the cylinder lying between the intake and exhaust ports bounds a combustion chamber defined between the end surfaces of the pistons when the pistons move through their TC locations. This intermediate portion bears the highest levels of combustion temperature and pressure that occur during engine operation, and the presence of openings for devices such as fuel injectors, valves, and/or sensors in the intermediate portion diminish its strength and make it vulnerable to cracking, particularly through the fuel and valve openings.

Practice as per the above-identified related US applications has been to strengthen and cool the cylinder by means of a compression sleeve that encircles and reinforces the intermediate portion of the liner. The compression sleeve includes an impingement cooling construction constituted of coolant jets arranged radially around the liner. The coolant jets are formed by drilling multiple holes through the compression sleeve. The holes accelerate a liquid coolant so that it strikes the liner at the point where cooling is most desired. The coolant then flows through machined channels cut into the liner that lead away from the intermediate portion, towards the two ends of the cylinder. This construction has been effective in controlling temperatures in the intermediate portion of the liner.

However, while effective at cooling, the impingement construction also creates challenges. For example, the coolant path that delivers liquid coolant to the intermediate portion of the liner immediately splits into two separate, oppositely-directed coolant return branches, each comprising multiple elongated channels extending from the intermediate portion toward a respective end of the liner. The coolant return branches converge at some point beyond the liner, which makes for complicated coolant routing and, typically, complex cores in the cylinder block.

Another objection to the impingement construction is that it places a premium on the engine space around the cylinder, particularly in the intermediate portion of the liner where room must be found for coolant jets, fuel injectors, valves, and, possibly, sensors. In addition, due to the compression sleeve, the intermediate portion typically has the largest diameter of the cylinder, which leads to competition for engine space among neighboring cylinders. The competition can compromise the coolant core shape and/or the coolant flow balance from jet to jet.

Moreover, the impingement cooling construction is complicated and expensive to manufacture. Holes are drilled through the compression sleeve to create the jets and the cylinder liner is machined to form lands and grooves on the liner surface which define the coolant return channels.

SUMMARY OF THE DISCLOSURE

A cylinder for opposed-piston engines includes a liner with a bore and longitudinally displaced intake and exhaust ports near respective ends thereof. An intermediate portion of the liner between the exhaust and intake ports contains a combustion chamber formed when the end surfaces of a pair of pistons disposed in opposition in the bore are in close mutual proximity. A compression sleeve encircles and reinforces the intermediate portion of the liner. An annular grid of pegs disposed between the intermediate portion and the compression sleeve supports the liner against the compression sleeve and defines a turbulent liquid flow path extending across the intermediate portion in a direction that parallels the longitudinal axis of the liner.

The peg construction permits liquid coolant to flow in a single longitudinal direction on the external surface of the liner's intermediate portion. Preferably, but not necessarily, the direction is from the intake port to the exhaust port. As a result, introduction of the coolant can be moved away from the openings for devices such as fuel injectors, valves, and/or sensors. Coolant network complexity is reduced and costly and time consuming machining is eliminated. At the same time, mechanical reinforcement and effective cooling are provided in the portion of the cylinder where the heat of combustion is most intense. The grid of pegs is easy to manufacture and is an especially effective cylinder cooling construction for opposed-piston engines.

DETAILED DESCRIPTION

Figure 1:
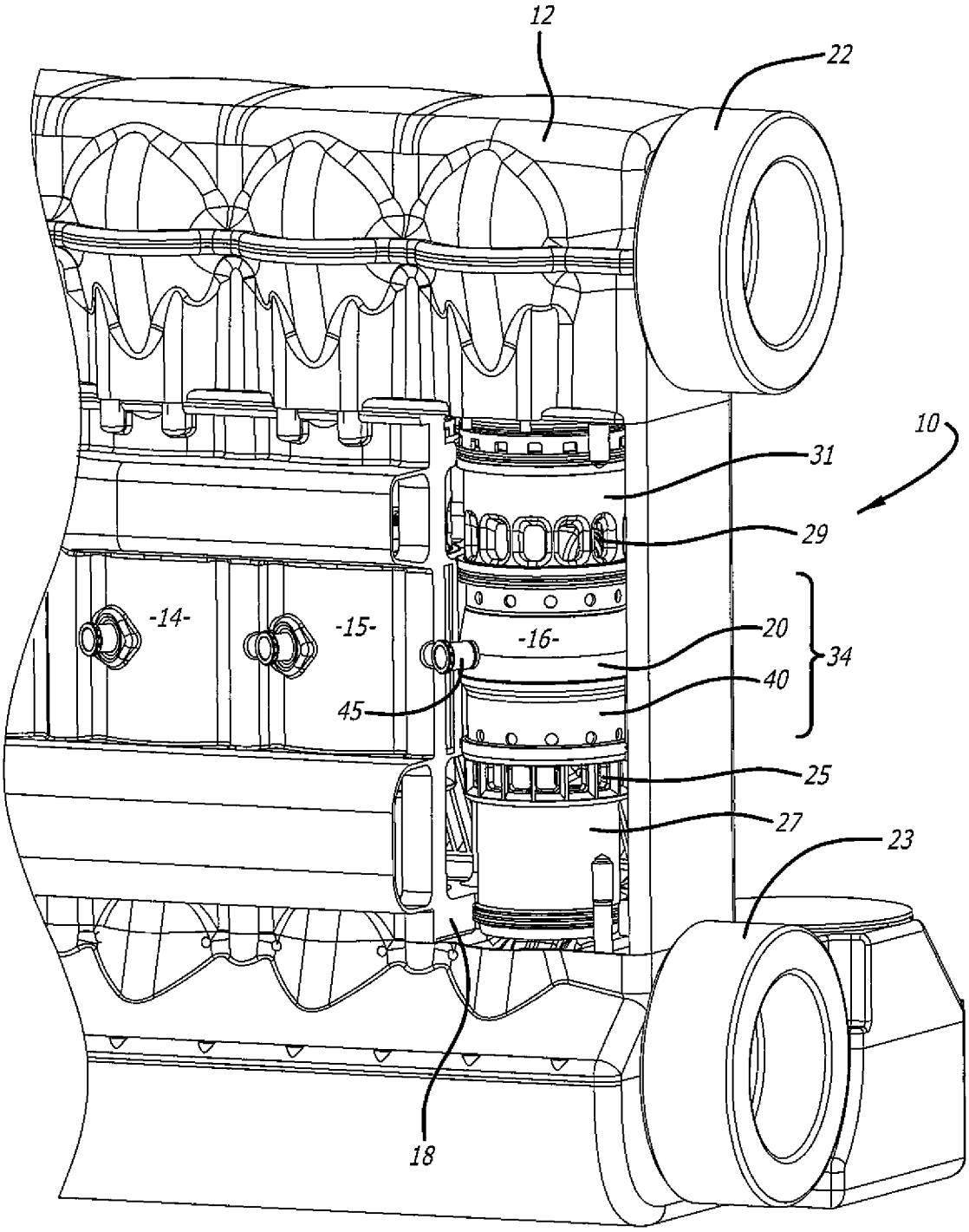
FIG. 1 shows placement of a cylinder according to this disclosure in an opposed-piston engine.

The figures illustrate a cylinder structure for opposed-piston engines that includes a liner with a bore and longitudinally displaced intake and exhaust ports near respective ends thereof. FIG. 1 shows an opposed-piston engine 10 with a cylinder block 12 with three identically-constructed cylinders 14, 15, and 16. A portion of the cylinder block 12 is removed to show the construction of the cylinder 16 which includes a cylinder tunnel 18 formed in the block in which a cylinder liner 20 is supported. The engine 10 includes two crankshafts 22 and 23. The cylinder liner 20 includes an intake port 25 near a first liner end 27, exhaust port 29 near a second liner end 31, and an intermediate portion 34 situated between the intake and exhaust ports. As per FIG. 2A, a pair of pistons 35 and 36 are disposed in the bore 37 of the liner with their end surfaces 35*e* and 36*e* in opposition. As per FIGS. 1 and 3, compression sleeve 40 is received over the liner 20. A fuel injector 45 is supported in an opening 46 through the sidewall of the cylinder for direct injection of fuel into the combustion chamber.

Figure 2A:
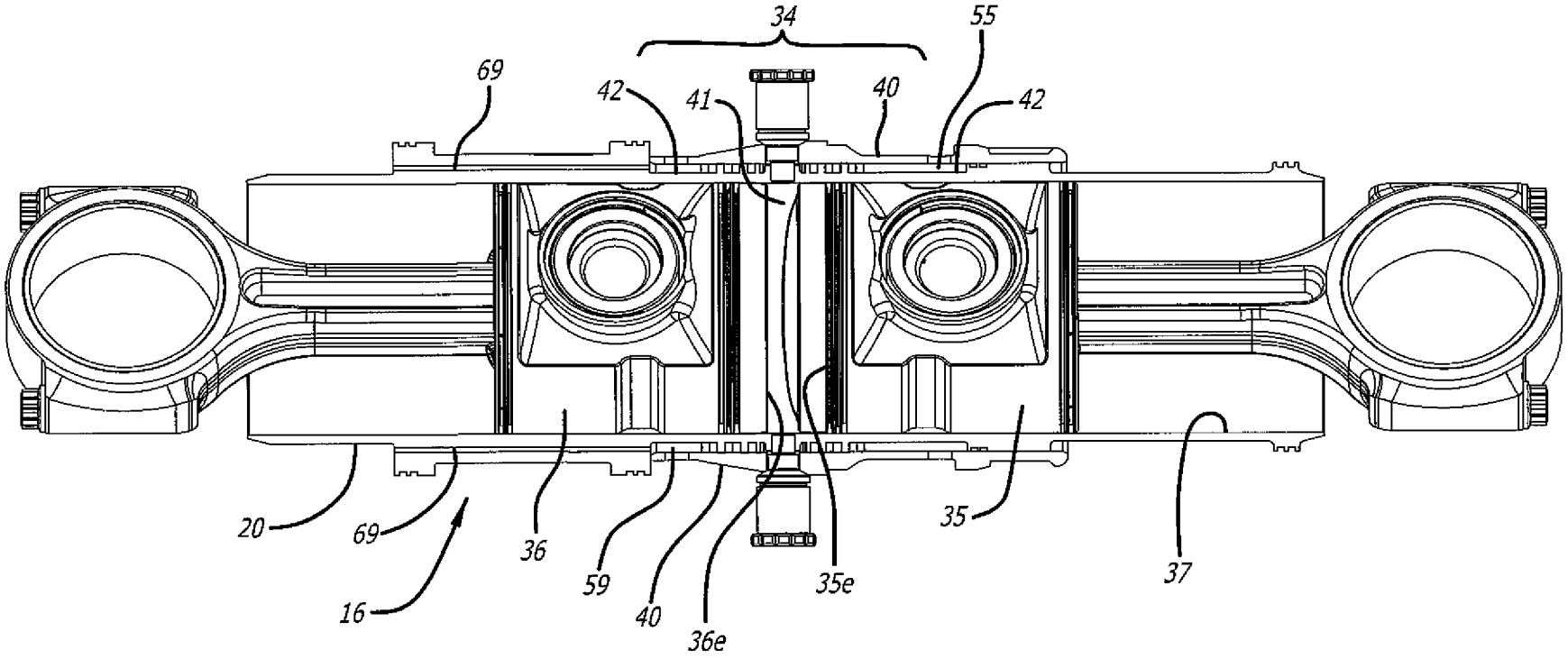
FIG. 2A is a longitudinal section of a cylinder construction in accordance with this disclosure, with opposing pistons received in a liner.
Figure 2B:
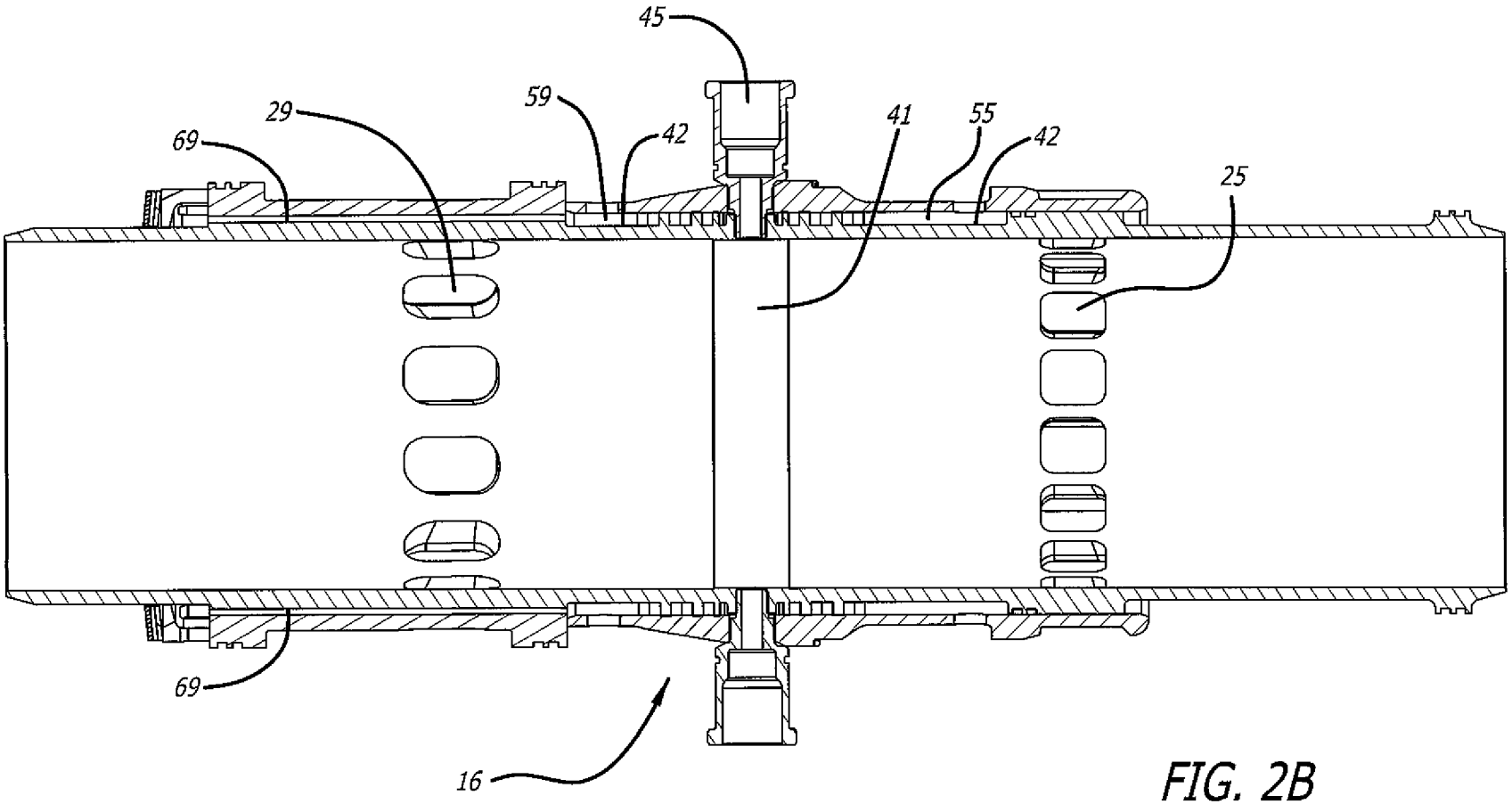
FIG. 2B is a longitudinal section of the cylinder construction of FIG. 2A, without pistons.

FIGS. 2A, 2B, 3, and 4 show details of the structure of the cylinder 16 which includes the liner 20 with the compression sleeve 40 closely encircling and reinforcing the portion of the liner 20 that extends from the intake port 25 to the intermediate portion 34. As seen in FIG. 2A, the intermediate portion 34 contains a combustion chamber 41 formed when the end surfaces 35*e* and 36*e* of the pair of pistons 35 and 36 disposed in opposition in the bore are in close mutual proximity. The compression sleeve 40 is formed to define generally cylindrical space between itself and the external surface 42 of the liner through which a liquid coolant may flow in an axial direction from near the intake port toward the exhaust port. The strength of the intermediate portion 34 is reinforced by an annular grid 50 of pegs 52 that extend between the intermediate portion 34 and the compression sleeve 40. The grid 50 closely encircles the intermediate portion 34, which is subjected to the high pressures and temperatures of combustion. The pegs 52 support the liner intermediate portion 34 against the compression sleeve 40. The grid 50 also defines an annular turbulent liquid flow path extending across the intermediate portion 34.

A generally annular space 55 is formed between the external surface 42 of the liner and the compression sleeve 40. This space abuts the side of the liner intermediate portion 34 that faces the intake port 25 and is in fluid communication with the turbulent liquid flow path defined by the grid 50. Another generally annular space 59 is formed between the external surface 42 of the liner and the compression sleeve 40. This space abuts the side of the liner intermediate portion 34 that faces the exhaust port 29; and it is in fluid communication with the turbulent liquid flow path defined by the grid 50. One or more coolant entry ports 61 formed in the compression sleeve 40 are positioned over and in fluid communication with the annular space 55 and one or more coolant exit ports 63 formed in the compression sleeve are positioned over and in fluid communication with the annular space 59.

Figure 3:
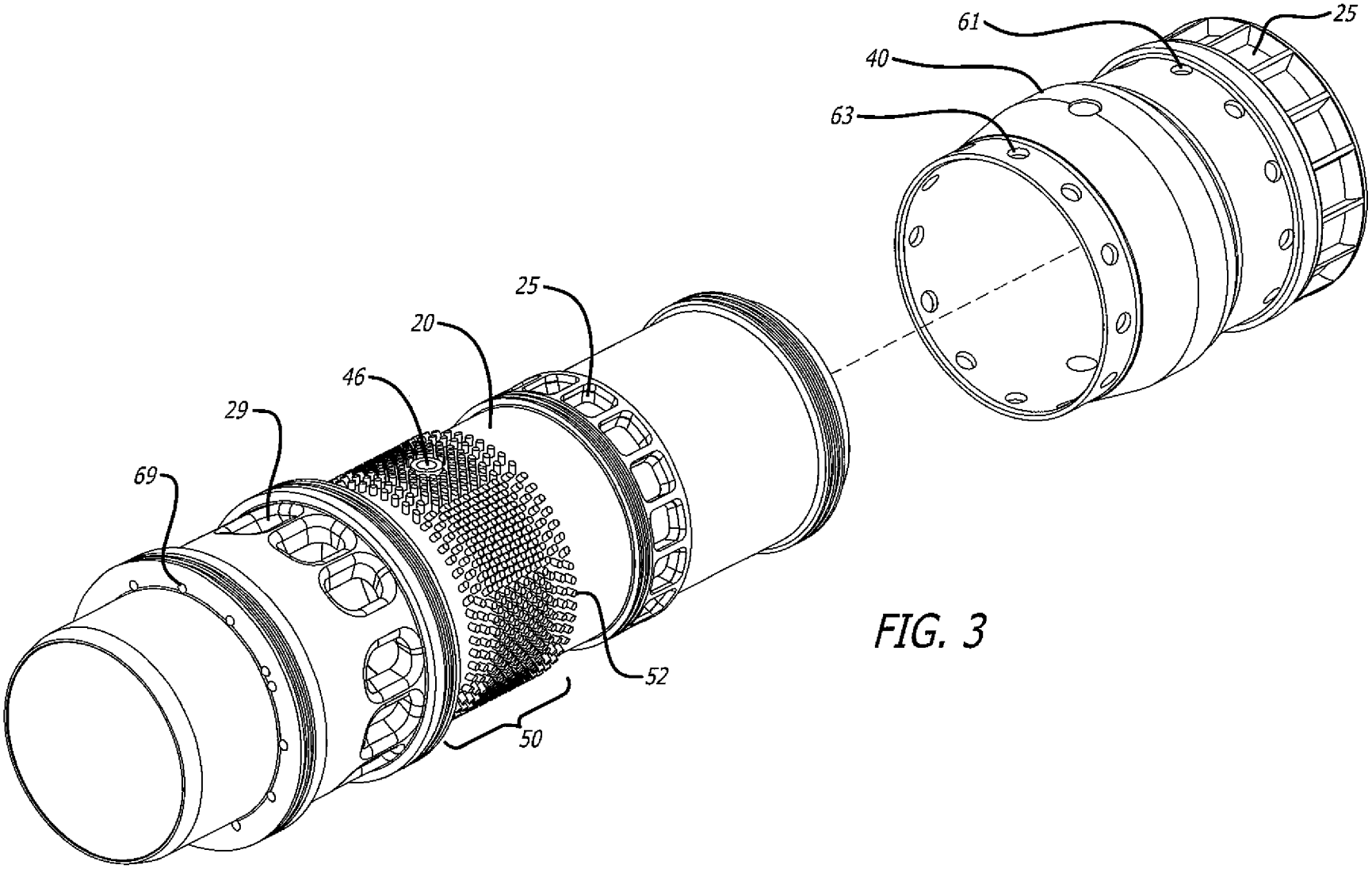
FIG. 3 is an exploded view showing elements of the cylinder construction of FIGS. 2A and 2B.
Figure 4:
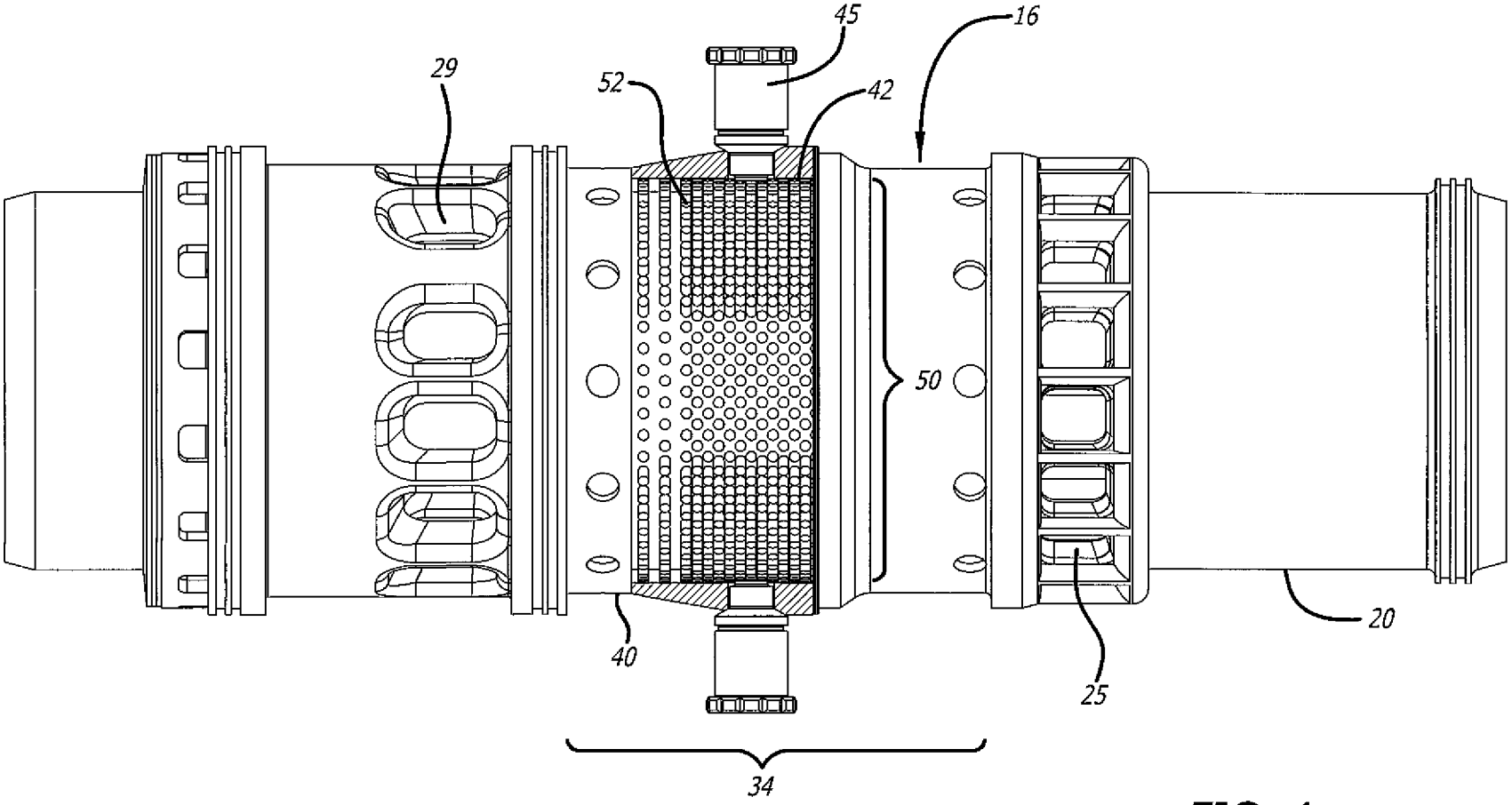
FIG. 4 is a side elevation view of the cylinder construction of FIGS. 2A and 2B with a cut-away of a portion of the compression sleeve to show the coolant grid area.
Figure 5:
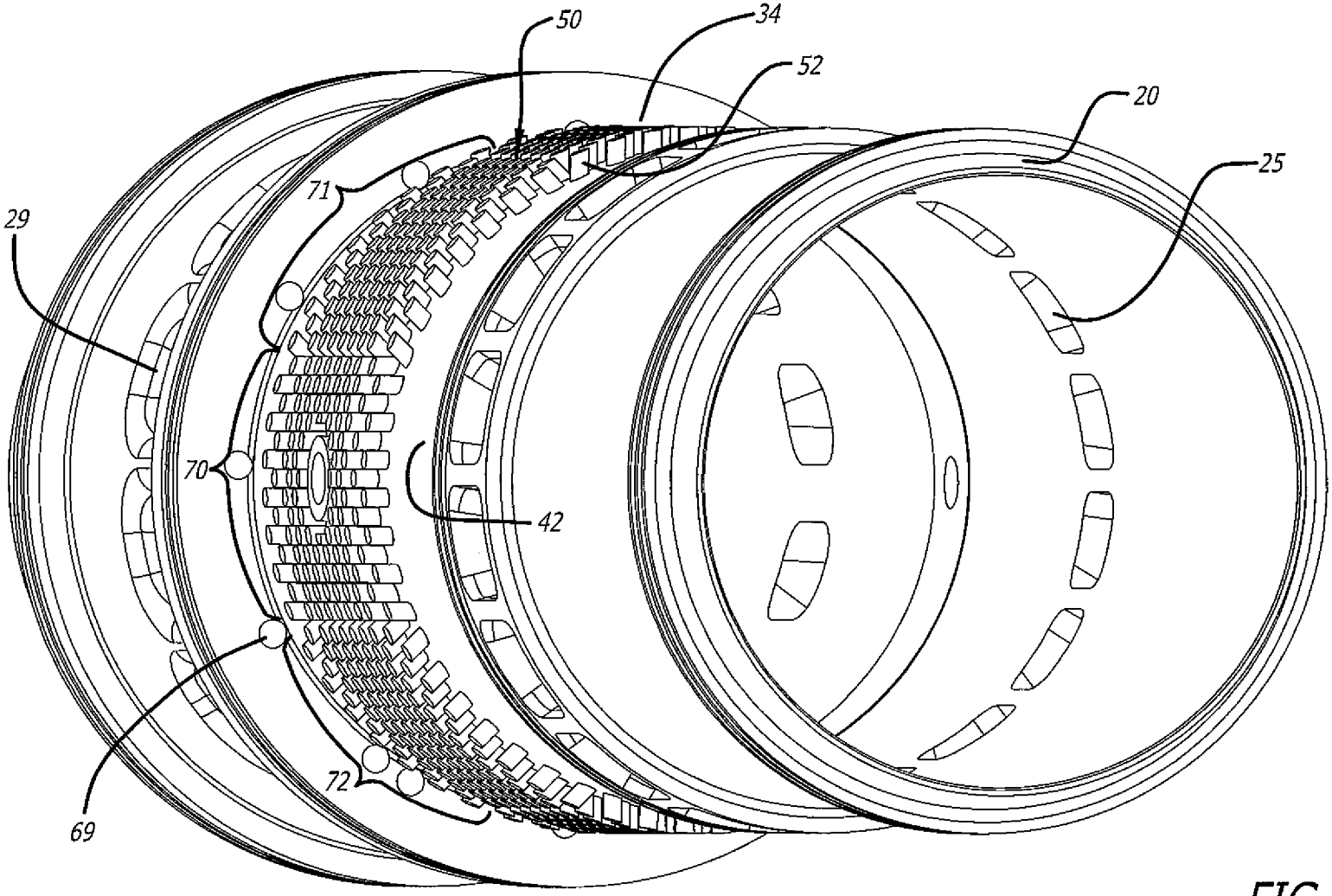
FIG. 5 is a magnified perspective view showing a further structural detail of the cylinder construction of FIGS. 2A and 2B.

As per FIGS. 3 and 5, the grid pegs 52 may be provided in enough density to closely surround and reinforce those sectors of the intermediate portion where bosses 46 locate and support injector nozzles, valves, and the like. Advantageously, the maze of interstices among the grid pegs 52 affords access of liquid coolant to the entirety of the outside surface of each boss 46 and to the external surface area of the liner immediately adjacent to the boss.

During operation of the opposed-piston engine 10, the cylinder 16 is cooled by introducing a liquid coolant (such as a water-based mixture) into the space defined between the compression sleeve 40 and the external surface 42 of the liner. The coolant is pumped through a coolant channel in the cylinder block 12 that is in fluid communication with the annular space 55. The pumped coolant enters the annular space 55 via the coolant entry ports 61, which causes the coolant to flow on the external surface 42, toward the intermediate portion 34 of the liner 20. The pump pressure causes the liquid coolant to flow through the grid 50 wherein the pegs 52 act as an annular maze of turbulators that encircles the intermediate portion 34 and generates turbulent flow of the coolant across the intermediate portion. The turbulent flow increases the heat transfer efficiency to the liquid coolant flowing over the intermediate portion 34. The pressure of coolant flowing through the grid 50 causes the liquid coolant to flow from the intermediate portion 34 toward the exhaust port 29 and into the annular space 59. From the annular space 59, the coolant flows to and through a return channel formed in the cylinder block 12. In some instances, coolant may be routed from the annular space 59 through channels 69 that pass on, over, or through the exhaust port bridges.

As best seen in FIG. 5, the annular grid of pegs that closely encircles the intermediate section 34 includes a plurality of pegs formed integrally with the liner 20, on the external surface 42 of the intermediate portion 34. The pegs 52, which extend outwardly from the external surface 42, have a three-dimensional shape which is shown as cylindrical in FIG. 5. However, the illustrated shape is not meant to be limiting and may be selected from the group including cylindrical, conical, and polyhedral shapes and/or any equivalents thereof. The pegs 52 may be formed radially with respect to the cylindrical shape of the liner 20. However, it may be easier to form the pegs by a casting process using cores that can be pulled outwardly away from the liner 20. In this instance, the intermediate portion 34 of the liner may be divided into a sequence of contiguous arcuate sections. In each section the pegs are formed to be mutually parallel. As seen in FIG. 5, the annular grid 50 of pegs 52 would thus comprise a plurality of sets 70, 71, 72, etc. of pegs in a circumferential sequence on the external surface 42 of the intermediate portion 34, in which the pegs 52 of each set (70, for example) are mutually parallel within the set but are not parallel with the pegs of adjacent sets (71 and 72, for example). In any case, in a final manufacturing step, the end surfaces of the pegs 52 may be machined so as to fit closely to the interior surface of the sleeve.

The liner and compression sleeve are made from compatible metal materials such as cast iron (liner) and hardened steel (compression sleeve) and then joined by friction fit, by shrinking the compression sleeve to the liner, or by metal-to-metal bonding, or by any other suitable means.

While embodiments of a cylinder liner structure for an opposed-piston engine have been illustrated and described herein, it will be manifest that such embodiments are provided by way of example only. Variations, changes, additions, and substitutions that embody, but do not change, the principles set forth in this specification, should be evident to those of skill in the art.

The invention claimed is:

1. A cylinder for opposed-piston engines, comprising:

a liner with a bore and longitudinally displaced intake and exhaust ports near respective ends of the liner;

the liner including an intermediate portion between the exhaust and intake ports that contains a combustion chamber formed when the end surfaces of a pair of pistons disposed in opposition in the bore are in close mutual proximity;

a compression sleeve encircling and reinforcing the intermediate portion of the liner; and, an annular grid of pegs extending between the intermediate portion and the compression sleeve that supports the liner against the compression sleeve and that defines an annular turbulent liquid flow path extending across the intermediate portion in a single longitudinal direction of the liner.

2. The cylinder for opposed-piston engines of claim 1, further including a first annular space between the external surface of the liner and the compression sleeve and between the intake port and the intermediate portion that is in fluid communication with the turbulent liquid flow path.

3. The cylinder for opposed-piston engines of claim 2, further including a second annular space between the external surface of the liner and the compression sleeve and between the exhaust port and the intermediate portion that is in fluid communication with the turbulent liquid flow path.

4. The cylinder for opposed-piston engines of claim 3, further including at least one coolant entry port in the compression sleeve that is positioned over and in fluid communication with the first annular space and at least one coolant exit port in the compression sleeve that is positioned over and in fluid communication with the second annular space.

5. The cylinder for opposed-piston engines of claim 1, in which the annular grid of pegs is formed on the external surface of the intermediate portion of the liner.

6. The cylinder for opposed-piston engines of claim 1, in which the annular grid of pegs is constituted of a plurality of exterior projections that extend outwardly from the external surface of the intermediate portion of the liner.

7. The cylinder for opposed-piston engines of claim 6, in which the pegs have a three-dimensional shape selected from the group including cylindrical, conical, and polyhedral shapes.

8. The cylinder for opposed-piston engines of claim 1, in which the annular grid of pegs comprises a plurality of sets of pegs in a circumferential sequence on the external surface of the intermediate portion of the liner, and in which the pegs of each set are mutually parallel but are not parallel with the pegs of adjacent sets.

9. An opposed-piston engine comprising a cylinder block with a plurality of cylinders, in which each cylinder is constructed according to any one of claims 1-8.

10. The cylinder for opposed-piston engines of claim 1, wherein the liquid flow path extends in an axial direction from near the intake port toward the exhaust port.

11. A method of cooling a cylinder of an opposed-piston engine in which the cylinder includes a liner with a bore and longitudinally displaced intake and exhaust ports near respective ends thereof, the method comprising:

causing a liquid coolant to flow on an external surface of a cylinder liner, toward an intermediate portion of the liner between the exhaust and intake ports that contains a combustion chamber formed when the end surfaces of a pair of pistons disposed in opposition in the bore are in close mutual proximity;

causing the liquid coolant to flow through a maze of turbulator pegs encircling the intermediate portion; and causing the liquid coolant to flow in a single longitudinal direction of the liner from the inlet port toward the exhaust port.

12. The method of claim 11, in which the liquid coolant is caused to flow into a first annular space formed between an external surface of the liner and a compression sleeve, then the liquid coolant continues to flow toward the intermediate portion, and flows from the intermediate portion toward a second annular space encircling the external surface of the liner between the exhaust port and the intermediate portion, in which:

the compression sleeve closely encircles and reinforces the portion of the liner that extends from the intake port to the intermediate portion, the liquid coolant enters through at least one coolant entry port in the compression sleeve positioned over and in fluid communication with the first annular space, and the first annular space abuts the intermediate portion that faces the intake port.

13. A cylinder of an opposed-piston engine, comprising:

a bore and longitudinally displaced intake and exhaust ports;

an intermediate portion between the exhaust and intake ports that contains a combustion chamber formed when the end surfaces of a pair of pistons disposed in opposition in the bore are in close mutual proximity, an annular grid of pegs formed on an external surface of the intermediate portion that defines an annular turbulent liquid flow path extending across the intermediate portion in a single longitudinal direction of the cylinder, such that in use a liquid coolant flows in an axial direction from near the intake port toward the exhaust port.

14. The cylinder of claim 13, wherein the pegs surround and reinforce sectors of the intermediate portion where bosses locate and support injector nozzles and valves.

15. A method of cooling a cylinder of an opposed-piston engine in which the cylinder includes a bore and longitudinally displaced intake and exhaust ports near respective ends thereof, the method comprising:

causing a liquid coolant to flow toward an intermediate portion of the cylinder between the exhaust and intake ports that contains a combustion chamber formed when the end surfaces of a pair of pistons disposed in opposition in the bore are in close mutual proximity;

causing the liquid coolant to flow in a single longitudinal direction of the cylinder through a maze of turbulator pegs encircling the intermediate portion; and, causing the liquid coolant to flow from the intermediate portion toward the exhaust port.

* * * * *